US007997201B2

(12) United States Patent
Till

(10) Patent No.: US 7,997,201 B2
(45) Date of Patent: Aug. 16, 2011

(54) METHOD AND DEVICE FOR LABELING CONTAINERS

(75) Inventor: Volker Till, Hofheim am Taunus (DE)

(73) Assignee: KHS AG, Dortmund (DE)

( * ) Notice: Subject to any disclaimer, the term of this patent is extended or adjusted under 35 U.S.C. 154(b) by 380 days.

(21) Appl. No.: 12/255,876

(22) Filed: Oct. 22, 2008

(65) Prior Publication Data

US 2009/0133593 A1 May 28, 2009

Related U.S. Application Data

(63) Continuation-in-part of application No. PCT/EP2007/002999, filed on Apr. 3, 2007.

(30) Foreign Application Priority Data

Apr. 24, 2006 (DE) ..... 10 2006 019 441

(51) Int. Cl.
*B41F 17/16* (2006.01)

(52) U.S. Cl. ..... 101/485; 101/35; 101/41; 156/277; 156/DIG. 17

(58) Field of Classification Search ..... 101/35, 101/41, 485; 156/DIG. 17; *B41F 17/16*
See application file for complete search history.

(56) References Cited

U.S. PATENT DOCUMENTS 4,814,031 A 3/1989 Zodrow
5,967,676 A * 10/1999 Cutler et al. ..... 400/70
6,811,648 B1 * 11/2004 Dominico ..... 156/277
2004/0035824 A1 2/2004 Grimard
2005/0088510 A1 4/2005 Assa et al.
2005/0248618 A1 11/2005 Pinard et al.

FOREIGN PATENT DOCUMENTS

| | | |
|---|---|---|
| DE | 20 2006 000214 | 4/2006 |
| DE | 20 2006 000270 | 4/2006 |
| EP | 1 435 296 | 7/2004 |
| FR | 1 174 994 | 3/1959 |
| WO | WO 93/23292 | 11/1993 |
| WO | WO 2004/056658 | 7/2004 |
| WO | WO 2006/073538 | 7/2006 |

OTHER PUBLICATIONS

International Search Report PCT/EP2007/002999 and English translation thereof, mailed Jul. 30, 2007.

International Preliminary Report on Patentability PCT/EP2007/002999 and English translation thereof.

* cited by examiner

*Primary Examiner* — Leslie J Evanisko
(74) *Attorney, Agent, or Firm* — Nils H. Ljungman & Associates

(57) ABSTRACT

A method of labeling bottles and a machine therefor in which indicia on the bottles is monitored to determine where to produce indicia on at least one predetermined portion substantially transverse to a longitudinal container axis of each container, such as the top of a bottle cap. The indicia is aligned with the orientation of at least one indicium, such as a side label, on at least one portion of the same container in a predetermined spatial relationship.

20 Claims, 4 Drawing Sheets

METHOD AND DEVICE FOR LABELING CONTAINERS

CONTINUING APPLICATION DATA

This application is a Continuation-In-Part application of International Patent Application No. PCT/EP2007/002999, filed on Apr. 3, 2007, which claims priority from Federal Republic of Germany Patent Application No. 10 2006 019 441.1, filed on Apr. 24, 2006. International Patent Application No. PCT/EP2007/002999 was pending as of the filing date of this application. The United States was an elected state in International Patent Application No. PCT/EP2007/002999.

BACKGROUND

1. Technical Field

The present application relates to a method for printing bottles or the like containers and to a device for carrying out the method.

2. Background Information

Background information is for informational purposes only and does not necessarily admit that subsequently mentioned information and publications are prior art.

Furthermore, a print head is known that is determined for printing flat printing material and with which a plurality of printing points can be produced in one line closely adjacent to one another or at a very small distance from one another, for example, at least one hundred and fifty printing points per inch on a surface to be printed of the printing material, namely through a plurality of individually controllable single jets. The active printing width of this print head, which is also known by the name "Tonejet," is possibly dependent on the capacity of the processing power of a computer to control the print head. Print heads of 1.7 to 6.8 inches printing width (corresponding to a 256 bit control or a 1024 bit control) are thus possible. With this print head the printing of a two-dimensional imprint with sufficiently large area through relative movement between the surface to be printed and the print head is possible in possibly only one axial direction.

It is often desired to apply closures, for example, bottle caps or screw tops, which have an imprint, for example in the form of an emblem, a brand or the like, on bottles or the like containers such that the imprint on the closure has a predetermined orientation with respect to the other equipment of the bottle or of the container, for example, with respect to one or more labels or other equipment features.

In order to achieve this, it has already been proposed with a labeling machine for labeling bottles to align the bottles standing upright before the application of the labels by rotation about their vertical bottle axis such that when the bottles reach the labeling unit the imprint on the bottle closures respectively has a predetermined orientation so that then after the labeling the imprint on the bottle closures and the equipment formed by the labeling have the desired uniform orientation.

However, this approach may require an optical detection of the random orientation of the imprint, and a subsequent mechanical alignment or rotation of the bottles about their bottle axis, to which end, i.a., a relatively complex motor drive of a rotary table serving as a stand area of the bottle, with correspondingly complex control is desired.

OBJECT OR OBJECTS

The object of the present application is to disclose a method and a device with which it is possible to achieve a uniform orientation of an imprint on a container surface oriented in a perpendicular or virtually perpendicular manner to a container axis and the other equipment of the container in a simplified manner.

To achieve this object, a method is embodied for applying at least one imprint on container surfaces of bottles or similar containers using at least one printing station with at least one electrically controllable printing unit. To apply at least one imprint on a container surface, which is oriented in a perpendicular or transverse manner to a container axis in a predetermined orientation with respect to a container equipment, the orientation of this container equipment and/or at least one equipment feature of the containers secured on a transporter from rotation about each container's respective container axis is detected. The respective imprint with the information thus characterizing the container equipment is applied in an electronically aligned manner such that it has the desired orientation with respect to the equipment of the container. A device for carrying out this method is the object of a method wherein the printing mask for the respective imprint comprises the complete design in terms of graphics, text, and/or image.

SUMMARY

One property of the method according to the present application lies in that starting from a purely random orientation of the containers with respect to the equipment features already present on this container, for example, a label already applied, at least one imprint is applied, for example, on the closure solely by electronic alignment or rotation of the master pattern available in digital form on the container surface oriented in a perpendicular or transverse manner to the container axis, such that the imprint produced has the desired orientation with respect to the other equipment of the container. An alignment or rotation around the container axis of the containers, possibly standing upright during printing, is not desired. Therefore, no complex control drives are desired either. Instead, the alignment of the imprint with respect to the other equipment of the respective container is carried out purely electronically or by means of software.

The printing unit is embodied thereby such that it generates the respective printed image aligned on the container surface depending on the control by an electronic control device or printer electronic system (computer), namely according to an electronic printing mask or a printing mask formed from a data record by means of software and stored for example in a memory of the printer electronic system. By changing this printing mask, an easy change or adjustment of the imprint is also possible, namely in every respect, i.e. in terms of content, graphics, color, image but also with respect to size and shape. The present application thus also provides the possibility as desired to change and/or update the respective imprint easily, namely, for example, depending on the respective product and/or the respective brand.

The printing unit in at least one possible embodiment has at least one print head that is embodied possibly as a "Tonejet" print head or as a print head corresponding to a "Tonejet" print head of this type. A print head of this type has a plurality of single jets on a print area that is arranged during printing of the area to be printed opposite to this area at a small distance, which single jets are provided in close succession in a print head longitudinal axis and are formed respectively by a jet opening and by an electrode assigned to each jet opening. The printing ink present in the print head does not exit from each individual jet or from the associated jet opening until, upon activation of an individual jet, the electrode assigned thereto is acted on with an electric voltage, the polarity and/or electric potential of which deviates from the polarity and/or electric potential of the print head or the printing ink in the print head so that through electrostatic forces a specific amount of printing ink is ejected or discharged from the jet opening of the activated single jet. A print head of this type is referred to below as an "electrostatic print head."

Containers as defined by the present application are, i.a., bottles, bottle-type containers, cans of various materials.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The present application is explained in more detail below on the basis of an exemplary embodiment based on the figures. They show.

DESCRIPTION OF EMBODIMENT OR EMBODIMENTS

Figure 1:
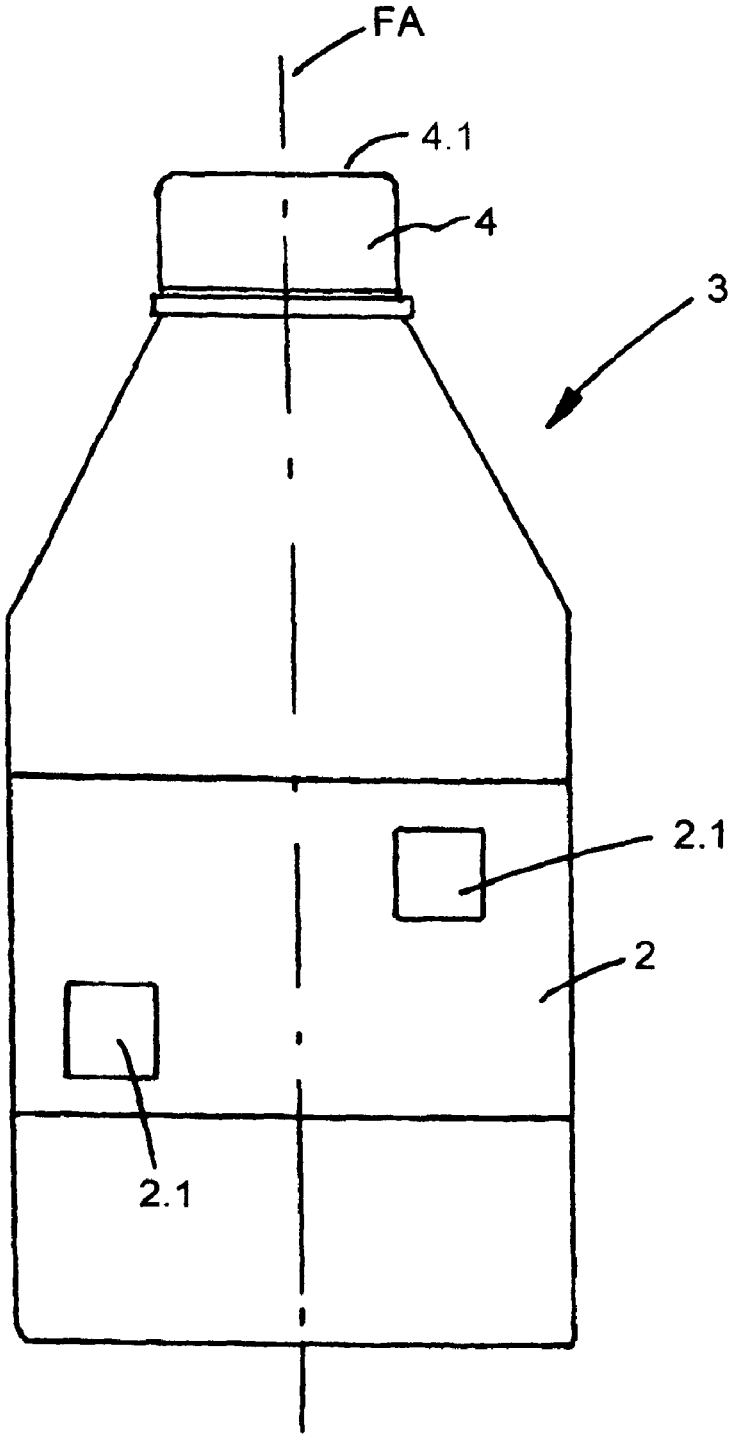
FIG. 1 shows in an individual representation a container embodied as a bottle together with a printing unit, represented diagrammatically, for printing the container closure.

In the figures, 1 is a labeling machine for applying labels 2 on containers embodied as bottles 3, which are closed on their top side or container opening by a closure 4. The labeling machine 1 is embodied in the known manner as a rotating machine, i.e. the bottles 3 are fed via a transporter 5 to a container intake 6 having a star-shaped feed device (not shown) and from there reach respectively successively container carriers, which are provided on the circumference of a rotor 7 driven in the direction of the arrow A around a vertical machine axis. With the rotating rotor 7, the bottles 3 are moved past at least one labeling unit 8, on which the glued labels 2 are transferred to the bottles 3, so that the labels 2 then are pressed onto or brushed onto the respective bottle 3 in a suitable manner, e.g., through successive pressure and/or brush-on elements, not shown. The bottles 3, for example, thus labeled in the conventional manner known to one skilled in the art then with the rotating rotor 7 reach the container outlet 9 or a star-shaped outlet device or star wheel 10, which has on its circumference several seats 10.1, one seat 10.1 for each one bottle 3, and is likewise driven about a vertical machine axis synchronously but in the opposite direction to the rotor 7, i.e. in the direction of the arrow B.

The bottles 3 respectively accommodated by a seat 10.1 are held in the star wheel 10 or in the seats 10.1 thereof in a rotationally fixed manner so that the bottles 3 cannot rotate about container vertical bottle axis FA.

The bottles 3 thus arranged in the seats 10.1 are moved with the star wheel 10 past one or more optoelectrical sensors 11, which are part of a sensor or image recognition and processing system 12 with which the labels 2 applied on the bottles 3 and/or marked areas or equipment features 2.1 of the labels are detected and, through comparison of the signals supplied by the sensors 11 with data stored in a memory 13 of the image recognition system 12, each random orientation of the label of each bottle 3 accommodated in a rotationally fixed manner in a seat 10.1 is determined. This information corresponding to the orientation of the respective label 2 is transmitted to a printer electronic system 14 (e.g., computer), which then controls a printer unit 15 to produce an imprint on the top side 4.1 of the closure 4. This imprint or print or image or printed image or text or graphics or a combination thereof is labeled generally in FIG. 2 by the letters VA and can be designed in any desired form, e.g., graphically and/or in color. However, the essential factor here is that, controlled through the information of the image processing system 12, the imprint is carried out on the top side 4.1 of the closures 4 of the bottles 3 still held in the seats 10.1 in a rotationally fixed manner in such a manner that this imprint VA has a predetermined alignment to the respective label 2, for example, to the marked areas 2.1 of this label 3. This alignment is carried out through corresponding "electronic" rotation or alignment of the printed image produced with the printing unit 15 purely by means of software. A mechanical alignment or rotation of the bottles 3 about the bottle axis FA may not be necessary.

In other words, in at least one possible embodiment of the present application, the bottles 3 are each transported to a seat 10.1 on the transport starwheel 10. Each bottle 3 is securely held on the transport starwheel 10 by a clamping device 18, so the bottle 3 cannot rotate about the vertical bottle axis FA. The bottles 3 in the seats 10.1 are moved past at least one optoelectrical sensor 11, which optoelectrical sensor 11 sends information to a sensor or image recognition and processing system 12. The optoelectrical sensors 11 detect marked areas or equipment features 2.1 of the labels 2, which labels 2 have previously been applied on bottles 3. The image processing system 12 compares the data sent from the optoelectrical sensors 11 with the data stored in a memory 13 of the image processing system 12. Through this comparison, the image processing system 12 determines the orientation of each label 2 on each bottle 3 in each seat 10.1. This information about the orientation of each label 2 is then sent from the image processing system 12 to an electronic printer system 14, which may be a computer. The electronic printer system 14 controls the printing unit 15, which printing unit 15 produces an imprint VA on each top side 4.1 of each closure 4 on each bottle 3. Because the image processing system 12 sends information about the orientation of each label 2 to the electronic printer system 14, each imprint VA is electronically rotated so that when the imprint VA is printed on a closure 4 on a rotationally fixed bottle 3, the imprint VA is oriented to be aligned with a corresponding label 2 on the same rotationally fixed bottle 3. The desired alignment of the imprint VA on the closure 4 with the marked areas 2.1 of label 2 is achieved by rotating the image to be printed rather than by rotating the bottle 3 and closure 4. The rotation of the image to be printed is produced by software.

In one possible embodiment of the present application, the sensors 11 may comprise different means for detecting markings 2.1, such as infrared sensors or ultraviolet sensors, etc.

The printing mask for the respective imprint VA is stored in a memory 16 of the printer electronic system 14, so that, as desired, the type of the closure imprint VA can also be easily changed solely through an electronic shift or a program change without a replacement of mechanical elements, such as, e.g., printing masks, being desired. The respective printing mask desired for the application of the imprint VA can be retrieved via an input device 17 from the memory 16 or selected and/or altered for the printing process.

The sensors 11 are, for example, electronic cameras that supply an image signal to the image processing system 12, in which the respective camera image is compared as an actual value to an image stored in the memory 13 as a desired value and from this the orientation of the respective label 2 is determined. Other systems are also conceivable, for example, scanner devices or systems with which marked areas or elements 2.1 of the respective label 3 are scanned, for example image components, such as, e.g., image edges or image transitions in the label typical of the label, or additional markings applied to the label, for example, those that also serve other purposes at the same time, for example, barcodes characterizing the product, information on the manufacturer, date of manufacture, etc.

Figure 2:
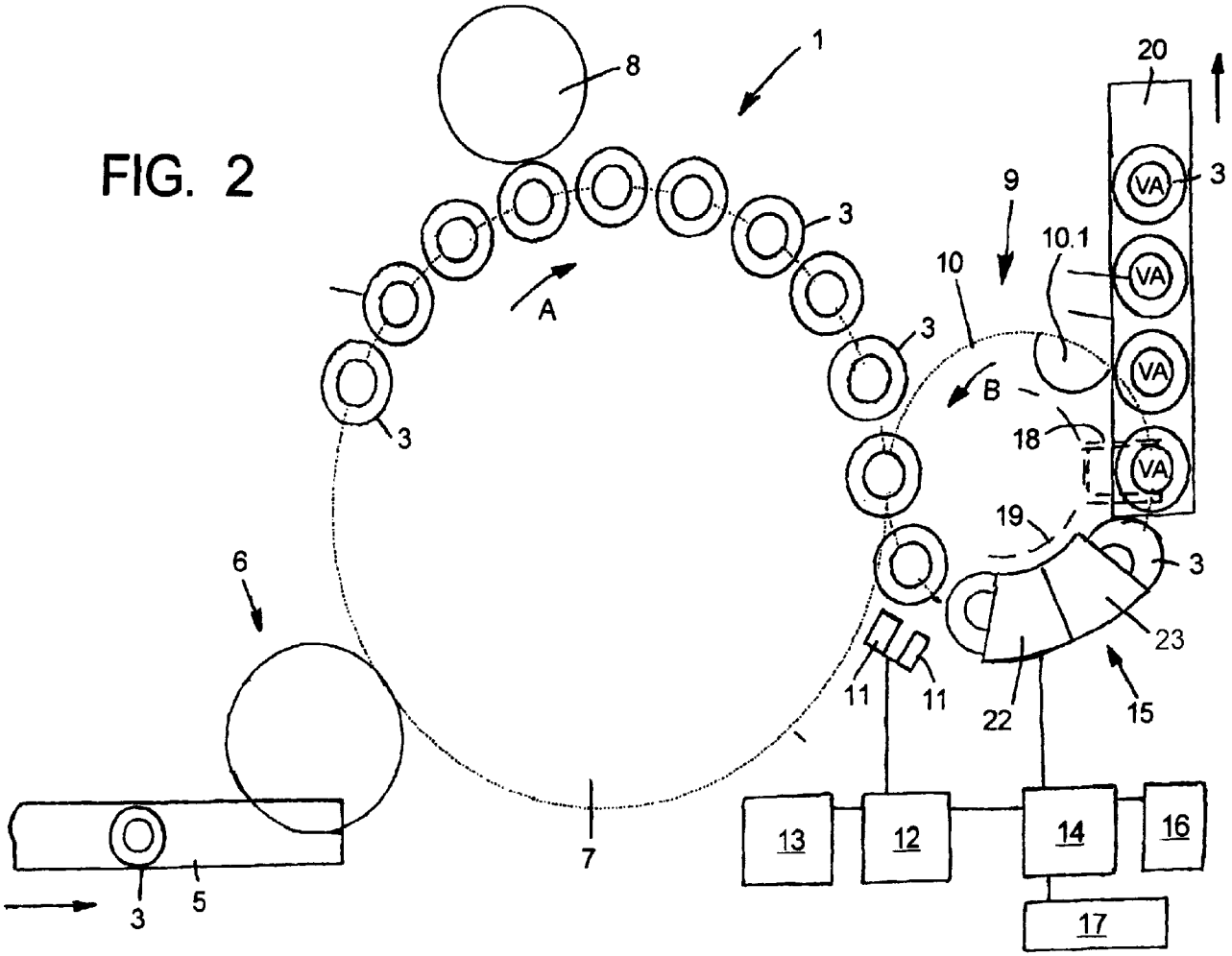
FIG. 2 shows in a diagrammatic representation and in plan view a labeling device for labeling the bottles together with the printing unit provided at the container outlet.

A clamping device, for example, is used for the rotationally fixed support of the bottles 3 in the respective seat 10.1, which clamping device is provided at each seat 10.1 and is indicated in FIG. 2 diagrammatically by 18. The clamping devices 18 can be controlled by a control cam 19. The bottles 3 printed on their closures 4 reach with the transport star wheel 10 a transporter 20, via which the bottles 3 are supplied to a further use or a further station, for example, to a packer.

The printing station 15, which is arranged in a locally fixed manner above the track of motion of the bottles 3 or of the closures 4 on the transport star wheel 10, comprises a printing unit 22 and a unit 23 following this in the rotational direction B for drying the respective imprint VA or printed image, namely depending on the printing ink used for the printing by heating or heat treatment or UV treatment, etc.

The printing station 15 can furthermore contain means that help to increase the sharpness and/or the contrast of the respective imprint VA, e.g., corona devices. Furthermore, there is the possibility of providing devices between the individual print heads 24, in order to dry the printing ink applied with the respective print head, for example, a color set of a multicolor printing at least such that another color set can be printed without a mixing of the printing inks occurring.

Figure 3:
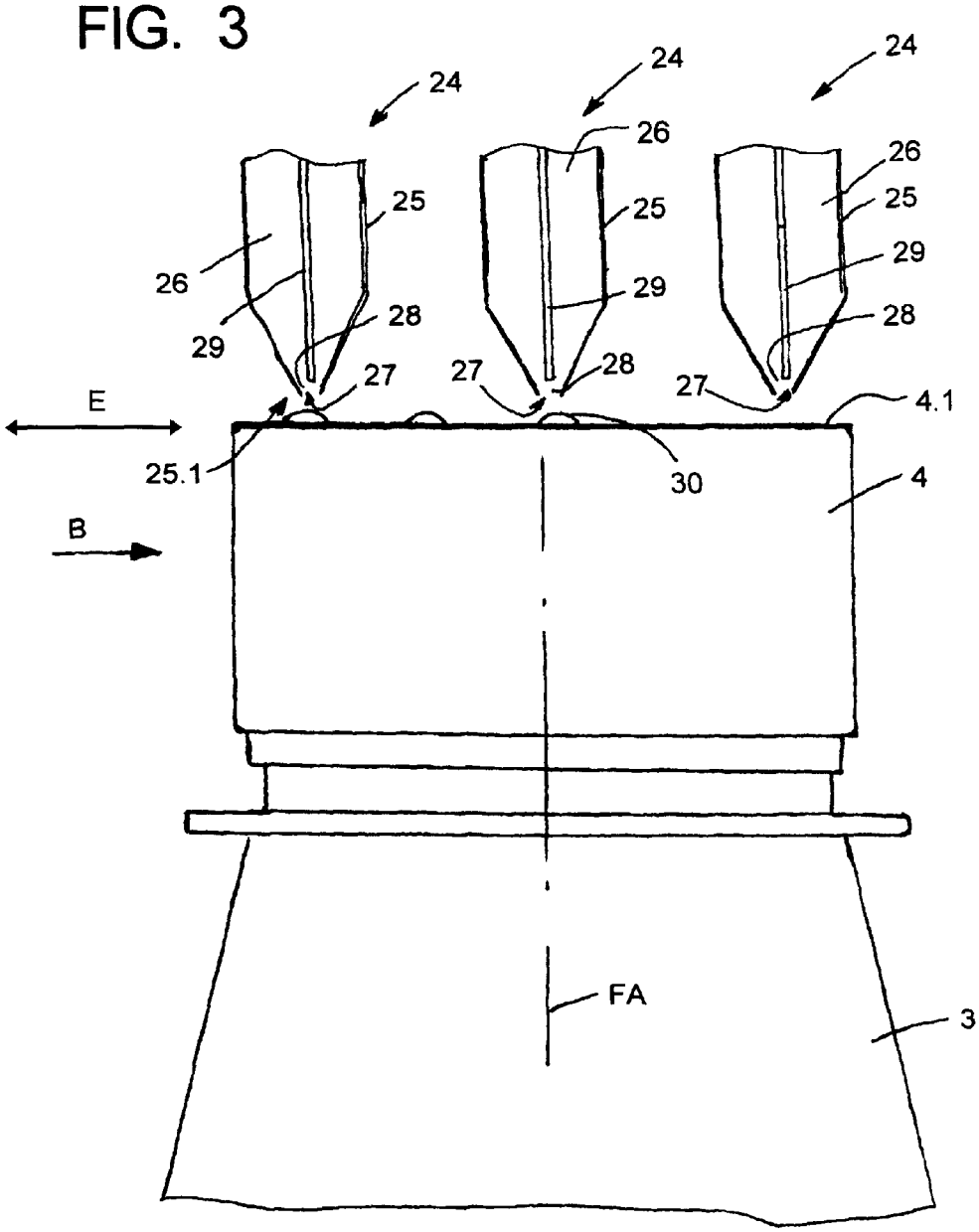
FIG. 3 shows in a diagrammatic representation the print heads of the printing unit embodied as electrostatic print heads together with a closure to be printed.
Figure 4:
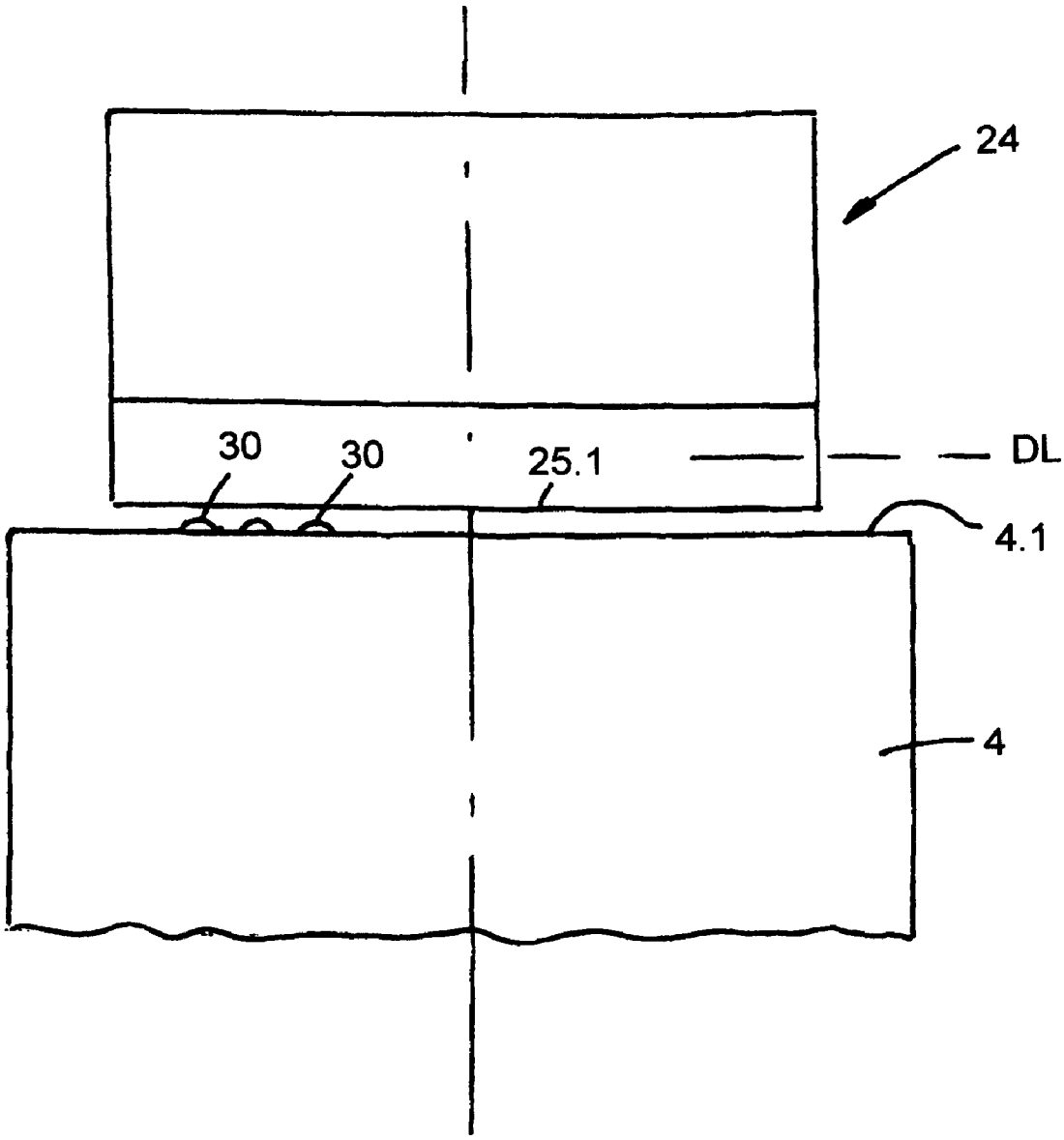
FIG. 4 shows one of the print heads of the printing unit in side view.

According to FIGS. 3 and 4, the printing unit 22 comprises several print heads 24 that are arranged transversely or in a perpendicular or virtually perpendicular manner to the direction of rotation B of the transport star wheel 10 at a small distance above the horizontal plane E (printing plane) on which the closures 4 move.

In this embodiment, the print heads 24 are embodied as electrostatic print heads. For a multicolor printing at least three print heads are provided, of which each serves to print one color set of a multicolor printing. The print heads thus contain in their coloring different printing inks, e.g., red, blue and yellow. Fundamentally, it is also possible to provide further print heads 24 on the printing unit 22, for example, a fourth print head 24 for black printing ink.

As FIGS. 3 and 4 show, each print head 24 essentially comprises a housing 25, which forms a closed interior 26 for accommodating the liquid or viscous printing ink. Each housing 25 is embodied such that the interior 26 narrows to a lower housing section 25.1 in a funnel-shaped or wedge-shaped manner. At this housing section 25.1, which extends over the entire length of each print head 24 or the housing 25 thereof, and is oriented parallel or virtually parallel to a housing or print head longitudinal axis DL and thus also parallel or virtually parallel to the printing pane E, a plurality of individually controllable single jets 27 is provided for the controlled discharge of the printing ink, namely in at least one row in the direction of the print head longitudinal axis DL following one another and in a close arrangement, so that, for example, one hundred and fifty single jets 27 per inch or more are formed on the housing section 25.1. With the housing section 25.1 having the single jets 27, each print head 24 is arranged at the referenced predetermined small distance above the top side 4.1 of the closures 4 to be printed or the printing plane. The closures 4 are moved during printing in the direction of rotation B continuously past the respective print head 24. Through the already mentioned orientation of the print heads 24, the direction of movement B is thereby oriented transversely, however, possibly perpendicular to the print head longitudinal axis DL of the print heads 24. With the embodiment shown the print heads 24 are arranged parallel or virtually parallel to one another in the horizontal direction with their print head longitudinal axis DL, namely preferably in a joint horizontal plane.

Each single jet 27 comprises an opening 28 and a needle-shaped electrode 29 assigned to this opening 28, which is arranged along the same axis with the axis of the respective opening 28 and ends at a small distance from this opening 28 inside the housing interior 26. Each print head 24 is furthermore embodied such that at least during the printing process the printing ink accommodated in the housing interior 26 bears with a certain hydrostatic pressure against the openings 28 of the single jets 27. The cross section of the openings 28, however, is selected taking into consideration the viscosity and/or the surface tension of the printing ink such that when single jet 27 is not activated, printing ink is not discharged from the openings 28, despite the hydrostatic pressure.

The electrodes 29 can be controlled individually via the printer electronic system 14, namely such that when single jet 27 is not activated, the corresponding electrode 29 is located at the same electric potential as the printing ink in the housing interior 26. When a single jet 27 is activated, the electric potential of the associated electrode 29 through corresponding activation or control through the printer electronic system 14 is changed briefly or in a pulse-like manner so that printing ink for producing a printing point 30 on the respective closure 4 is discharged via the opening 28.

Since the print heads 24 are arranged transversely or in a perpendicular or virtually perpendicular manner with the print head longitudinal axis DL to the direction of movement B of the closures 4, the respective printing application VA is carried out respectively in rows that extend perpendicular or virtually perpendicular to the longitudinal extension or perpendicular or virtually perpendicular to the direction of movement B of the closures 4, namely progressively in the direction of movement B. The activation of the single jets 27 is possible at high speed. Furthermore, possibly one relative movement between the closures 4 and the respective print head 24 is desired for the printing, possibly the feed movement of the bottles 3 with the transport star wheel 10. For these reasons a high print rate can be achieved so that the labeling machined 1 can also work with high output. The respective print image is generated purely digitally in the printer electronic system 14 by corresponding control of the single jets 27.

The printing of the closures 4 takes place in the printing unit 22, for example, such that the imprint VA and/or the graphic and/or color design or equipment of the respective closure 4 is generated completely through the printing unit 22 on the neutral closure 4, or an imprint already present on the closures 4 is supplemented in a desired manner with the printing unit 22, for example, it is provided with an addition in terms of language, color and/or graphics.

Because the closures 4 are not printed until the labeling machine 1, and through the control of the printing unit 22 or the print heads 24 there by the printer electronic system 14 using print forms or print masks stored digitally or in terms of data, various advantageous possibilities result, i.e., i.a., the possibility of a quick shifting of the imprint VA to various products, an adjustment of the size of the respective imprint to the size of the closures 4, etc. Furthermore, an easy change of the imprint VA is possible solely through a new programming or a program change. There is also the possibility of changing the imprint VA during a running process, for example, in an extreme case to redesign the print image for each closure 4, possibly also in the manner that each print image or each imprint VA is then composed of a constant or substantially constant component remaining the same and of variable contents and/or information.

The drying or the setting of the printing ink, namely through heating or in another suitable manner, for example by curing under UV light, etc., is carried out in the unit 23 following the printing unit 22 in the direction of movement or direction of rotation B.

Naturally, to generate clear print images or imprints VA, the control of the print heads 24 or the single jets 27 is synchronized with the rotary motion of the star wheel 10.

The present application was described above based on one possible embodiment. Naturally, numerous changes or modifications are possible without thereby leaving the teaching on which the present application is based.

It was assumed above that the imprint VA on the closures 4 occurs respectively in an orientation corresponding to the orientation of the labels 2. It is fundamentally also possible that markings or marked design features of these containers provided on the bottles 3 or the like containers are used as a criterion for the orientation of the respective imprint. Also with an embodiment of this type the containers or bottles 3 are then guided past the at least one sensor 11 of the image processing system 12 in a random, not controlled or aligned orientation, so that the purely random orientation of the respective container is detected and then with the print station 15 through corresponding control of the printing unit 22 or through corresponding electronic rotation of the print image, the imprint VA takes place in the desired orientation.

In principle, the part of the labeling machine 1 described by way of example formed by the transport star wheel 10 or another transporter that renders possible a rotationally fixed transportation of the containers or bottles 3, of which at least one sensor 11, the image processing system 12, the electronic print control or printing electronic system and the electrically controllable printing station 15, can also form an independent machine, which is then arranged downstream, for example, of a labeling machine and/or to which the containers already provided with an equipment are supplied.

Even though the present application was described above in connection with the printing of closures 4 on bottles, the present application can also be used with other containers, namely not only for printing container closures but also for printing other container surfaces, possibly those that lie in planes perpendicular or virtually perpendicular to a container axis.

Within the scope of the present application it is provided that the printing mask for the respective imprint VA contains the complete design in terms of graphics, text and/or image of the area to be printed.

Likewise within the scope of the present application it is provided that the print mask for the respective imprint VA contains possibly a part of the design in terms of graphics, text and/or image of the area to be printed.

One feature or aspect of an embodiment is believed at the time of the filing of this patent application to possibly reside broadly in a method for applying at least one imprint VA on container surfaces of bottles or the like containers 3 using at least one printing station 15 with at least one electrically controllable printing unit 22, wherein to apply the at least one imprint VA respectively on a container surface 4.1 oriented in a perpendicular or virtually perpendicular or transverse manner to a container axis FA in a predetermined orientation with respect to a container equipment 2, 2.1, the orientation of this container equipment and/or at least one equipment feature 2, 2.1 of the containers 3 secured on a transporter 10 from rotation about their container axis FA is detected and the respective imprint VA with the information thus characterizing the container equipment 2 is applied in an electronically aligned manner such that it has the desired orientation with respect to the equipment 2 of the container 3.

Another feature or aspect of an embodiment is believed at the time of the filing of this patent application to possibly reside broadly in a method, wherein the orientation of the container equipment and/or the at least one equipment feature 2, 2.1 are detected by means of an optoelectric sensor system 11, 12, 13.

Yet another feature or aspect of an embodiment is believed at the time of the filing of this patent application to possibly reside broadly in a method, wherein at least one feature 2.1 of a label 2 applied to the container 3 serves as equipment feature.

Still another feature or aspect of an embodiment is believed at the time of the filing of this patent application to possibly reside broadly in a method, wherein at least one shaping feature of the container 3 serves as equipment feature.

A further feature or aspect of an embodiment is believed at the time of the filing of this patent application to possibly reside broadly in a method, wherein the at least one imprint VA is carried out on the top side 4.1 of a closure 4.

Another feature or aspect of an embodiment is believed at the time of the filing of this patent application to possibly reside broadly in a method, wherein the orientation of the equipment or of the at least one equipment feature 2.1 is detected by at least one optoelectric sensor 11, for example an image sensor of an image detection and/or processing system.

Yet another feature or aspect of an embodiment is believed at the time of the filing of this patent application to possibly reside broadly in a method, wherein the at least one image sensor 11 is an electronic camera or a scanner.

Still another feature or aspect of an embodiment is believed at the time of the filing of this patent application to possibly reside broadly in a method, wherein the printed image of the at least one imprint VA is produced depending on printing masks stored in a printer electronic system 14 electronically or by means of software.

A further feature or aspect of an embodiment is believed at the time of the filing of this patent application to possibly reside broadly in a method, wherein during printing of a plurality of containers 3 the printed image is at least partially changed during the printing process.

Another feature or aspect of an embodiment is believed at the time of the filing of this patent application to possibly reside broadly in a method, wherein the at least one imprint VA is carried out with relative movement between the printing station 15 or the printing unit 22 there and the container 3, namely line-by-line perpendicular or virtually perpendicular or transversely to the relatively movement.

Yet another feature or aspect of an embodiment is believed at the time of the filing of this patent application to possibly reside broadly in a method, wherein the at least one printing unit 22 has at least one electrostatic print head 24 with a plurality of individually controllable single jets 27 for the controlled discharge of printing ink, and that the single jets are arranged in at least one row following one another in a print head longitudinal axis DL.

One feature or aspect of an embodiment is believed at the time of the filing of this patent application to possibly reside broadly in a method, wherein the relative movement between the at least one print head 24 and the container surface 4.1 is carried out in a transverse or perpendicular or virtually perpendicular manner to the print head longitudinal axis DL.

Another feature or aspect of an embodiment is believed at the time of the filing of this patent application to possibly reside broadly in a method, wherein the container surface 4.1 is oriented horizontally or essentially horizontally during printing.

Yet another feature or aspect of an embodiment is believed at the time of the filing of this patent application to possibly reside broadly in a method, wherein the at least one print head 24 is arranged above the surface 4.1 to be printed.

Still another feature or aspect of an embodiment is believed at the time of the filing of this patent application to possibly reside broadly in a method, comprising and using at least two, often at least three print heads 24.

A further feature or aspect of an embodiment is believed at the time of the filing of this patent application to possibly reside broadly in a method, wherein to produce a multicolor imprint VA a color set of this imprint is produced with each print head 24.

Another feature or aspect of an embodiment is believed at the time of the filing of this patent application to possibly reside broadly in a method, wherein after application the printing ink is dried or set by the application of an energy source, for example, by heating and/or UV light.

Yet another feature or aspect of an embodiment is believed at the time of the filing of this patent application to possibly reside broadly in a method, wherein the at least one imprint VA is carried out in a labeling machine 1 after the labeling of the container 3.

Still another feature or aspect of an embodiment is believed at the time of the filing of this patent application to possibly reside broadly in a method, wherein the printing mask for the respective imprint VA comprises the complete design in terms of graphics, text and/or image.

A further feature or aspect of an embodiment is believed at the time of the filing of this patent application to possibly reside broadly in a method, wherein the printing mask for the respective imprint VA comprises part of the design in terms of graphics, text and/or image of the area to be printed.

Another feature or aspect of an embodiment is believed at the time of the filing of this patent application to possibly reside broadly in a device for printing bottles or the like containers 3 on a container surface 4.1 using at least one printing station 15 with at least one printing unit 21 electrically controllable by a printer electronic system 14, past which printing unit the containers 3 are moved on a transporter 10, wherein means 11, 12, 13 for detecting the random orientation of the equipment and/or at least one equipment feature 2.1 of the containers 3 secured from rotation about their container axis FA is provided on a transporter 10, that the at least one printing unit 22 for printing the containers 3 is arranged on the container surface 4.1 oriented in a perpendicular or virtually perpendicular or transverse manner to the container axis FA controlled by the printer electronic system 14 applies the at least one imprint VA aligned to the equipment 2 or equipment features 2.1.

Yet another feature or aspect of an embodiment is believed at the time of the filing of this patent application to possibly reside broadly in a device, wherein it is a component of a labeling machine 1.

One feature or aspect of an embodiment is believed at the time of the filing of this patent application to possibly reside broadly in a device, wherein it is an independent device.

Another feature or aspect of an embodiment is believed at the time of the filing of this patent application to possibly reside broadly in a device, wherein the transporter has seats 10.1 for accommodating one container 3 in each case.

Yet another feature or aspect of an embodiment is believed at the time of the filing of this patent application to possibly reside broadly in a device, wherein that the transporter comprises a star wheel 10 that can be driven rotating about a vertical machine axis.

Still another feature or aspect of an embodiment is believed at the time of the filing of this patent application to possibly reside broadly in a device, wherein the printing unit 22 is arranged for printing the topside 4.1 of container closures 4.

A further feature or aspect of an embodiment is believed at the time of the filing of this patent application to possibly reside broadly in a device, wherein the printing unit produces the at least one imprint VA depending on printing masks stored in the printer electronic system electronically or by software.

Another feature or aspect of an embodiment is believed at the time of the filing of this patent application to possibly reside broadly in a device, wherein the at least one imprint VA is carried out on the top side 4.1 of a closure 4.

Yet another feature or aspect of an embodiment is believed at the time of the filing of this patent application to possibly reside broadly in a device, comprising at least one optoelectric sensor 11, for example, an image sensor of an image detection and/or processing system for detecting the orientation of the equipment or the at least one equipment feature 2.1.

Still another feature or aspect of an embodiment is believed at the time of the filing of this patent application to possibly reside broadly in a device, wherein the at least one image sensor 11 is an electronic camera or a scanner.

Another feature or aspect of an embodiment is believed at the time of the filing of this patent application to possibly reside broadly in a device, comprising printing masks stored electronically or by software for producing the printed image of the at least one imprint VA.

Yet another feature or aspect of an embodiment is believed at the time of the filing of this patent application to possibly reside broadly in a device, wherein the at least one printing unit 22 has at least one electrostatic print head 24 with a plurality of individually controllable single jets 27 for the controlled discharge of printing ink, and that the single jets are arranged in at least one row one after the other in a print head longitudinal axis DL.

One feature or aspect of an embodiment is believed at the time of the filing of this patent application to possibly reside broadly in a device, wherein the container surface 4.1 is oriented horizontally or essentially horizontally during printing.

Another feature or aspect of an embodiment is believed at the time of the filing of this patent application to possibly reside broadly in a device, wherein the at least one print head 24 is arranged above the area 4.1 to be printed.

Yet another feature or aspect of an embodiment is believed at the time of the filing of this patent application to possibly reside broadly in a device, comprising at least two, often three print heads 24.

Still another feature or aspect of an embodiment is believed at the time of the filing of this patent application to possibly reside broadly in a device, wherein each print head 24 is provided for a color set for the imprint to produce a multicolor imprint VA.

A further feature or aspect of an embodiment is believed at the time of the filing of this patent application to possibly reside broadly in a device according to one of the preceding claims, comprising means for drying or setting the printing ink after the application by the application of an energy source, for example, by heating and/or UV light.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that any or all the examples of patents, published patent applications, and other documents which are included in this application and including those which are referred to in paragraphs which state "Some examples of . . . which may possibly be used in at least one possible embodiment of the present application . . . " may possibly not be used or useable in any one or more or any embodiments of the application.

The sentence immediately above relates to patents, published patent applications and other documents either incorporated by reference or not incorporated by reference.

Some examples of cameras or the like optical monitoring apparatus that may possibly be utilized or possibly adapted for use in at least one possible embodiment of the present application may possibly be found in the following U.S. Pat. No. 5,233,186 issued to Ringlien on Aug. 3, 1993; U.S. Pat. No. 5,243,400 issued to Ringlien on Sep. 7, 1993; U.S. Pat. No. 5,369,713 issued to Schwartz et al. on Nov. 29, 1994; U.S. Pat. No. 5,442,446 issued to Gerber et al. on Aug. 15, 1995; U.S. Pat. No. 5,661,295 issued to Buchmann et al. on Aug. 26, 1997; and U.S. Pat. No. 5,898,169 issued to Nodbryhn on Apr. 27, 1999.

Some examples of computer systems that may possibly be utilized or possibly adapted for use in at least one possible embodiment of the present application may possibly be found in the following U.S. Pat. No. 5,416,480 issued to Roach et al. on May 16, 1995; U.S. Pat. No. 5,479,355 issued to Hyduke on Dec. 26, 1995; U.S. Pat. No. 5,481,730 issued to Brown et al. on Jan. 2, 1996; U.S. Pat. No. 5,805,094 issued to Roach et al. on Sep. 8, 1998; U.S. Pat. No. 5,881,227 issued to Atkinson et al. on Mar. 9, 1999; and U.S. Pat. No. 6,072,462 issued to Moshovich on Jun. 6, 2000.

Some examples of labeling machines which may possibly be utilized in at least one possible embodiment may possibly be found in the following U.S. Pat. No. 6,634,400, entitled "Labeling machine;" U.S. Pat. No. 6,561,246, entitled "Labeling machine capable of precise attachment of a label to different sizes of containers;" U.S. Pat. No. 6,550,512, entitled "Labeling machine capable of preventing erroneous attachment of labels on containers;" U.S. Pat. No. 6,543,514, entitled "In-line continuous feed sleeve labeling machine and method;" U.S. Pat. No. 6,378,587, entitled "Cylindrical container labeling machine;" U.S. Pat. No. 6,328,086, entitled "Labeling machine;" U.S. Pat. No. 6,315,021, entitled "Labeling machine;" U.S. Pat. No. 6,263,940, entitled "In-line continuous feed sleeve labeling machine and method;" U.S. Pat. No. 6,199,614, entitled "High speed labeling machine having a constant tension driving system;" U.S. Pat. No. 6,167,935, entitled "Labeling machine; U.S. Pat. No. 6,066,223, entitled "Labeling machine and method; U.S. Pat. No. 6,050,319, entitled "Non-round container labeling machine and method;" and U.S. Pat. No. 6,045,616, entitled "Adhesive station and labeling machine."

Some examples of starwheels which may possibly be utilized or adapted for use in at least one possible embodiment may possibly be found in the following U.S. Pat. No. 5,613,593, entitled "Container handling starwheel;" U.S. Pat. No. 5,029,695, entitled "Improved starwheel;" U.S. Pat. No. 4,124,112, entitled "Odd-shaped container indexing starwheel;" and U.S. Pat. No. 4,084,686, entitled "Starwheel control in a system for conveying containers."

The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

All of the patents, patent applications or patent publications, which were cited in the International Search Report dated Jul. 30, 2007, and/or cited elsewhere are hereby incorporated by reference as if set forth in their entirety herein as follows: DE 20 2006 000270, published on Apr. 6, 2006, having the English translation of the German title "DEVICE FOR PRINTING INFORMATION ON BOTTLES COMPRISES AN ELECTROSTATIC PRINTING HEAD HAVING INDIVIDUAL NOZZLES FOR CONTROLLED RELEASE OF PRINTING INK;" US 2005/248618, published on Nov. 10, 2005, having the title "JET PRINTER WITH ENHANCED PRINT DROP DELIVERY;" WO 2004/056658, published on Jul. 8, 2004, having the title "A LABELLING AND/OR MARKING MACHINE;" DE 20 2006 000214, published on Apr. 20, 2006, having the English translation of the German title "BOTTLE LABELING MACHINE PRODUCES LABELS FROM STRIP OF MATERIAL USING PRINTER BUILT INTO LABELING STATION WHICH IS CONTROLLED BY SEPARATE ELECTRONIC CONTROL UNIT;" FR 1 174 994, published on Mar. 18, 1959, having the French title "DISPOSITIF POUR L'IMPRESSION D'UNE MARQUE D'IDENTIFICATION SUR UNE CAPSULE OU AUTRE ELEMENT DE FERMETURE;" and U.S. Pat. No. 4,814,031, published on Mar. 21, 1989, having the title "METHOD OF IMPRINTING THE UPPER SURFACE OF A CONTAINER."

The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2006 019 441.1, filed on Apr. 24, 2006, having inventor Volker TILL, and DE-OS 10 2006 019 441.1 and DE-PS 10 2006 019 441.1, and International Application No. PCT/EP2007/002999, filed on Apr. 3, 2007, having WIPO Publication No. WO2007/121835 and inventor Volker TILL, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the Foreign equivalent patent application PCT/EP2007/002999 and German Patent Application 10 2006 019 441.1 is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2007/002999 and DE 10 2006 019 441.1 from which this patent application claims priority which do not have to do with the correction of the translation in this patent application are not to be included in this patent application in the incorporation by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1 Labeling machine
2 Label
3 Bottle
4 Closure
5 Transporter
6 Container intake
7 Rotor
8 Labeling unit
9 Container outlet
10 Transport star wheel
10.1 Seat
11 Image sensor
12 Image processing system
13 Memory
14 Printer electronic system
15 Printing station
16 Memory
17 Input device
18 Clamping device
19 Control cam
20 Transporter
22 Printing unit
23 Unit for drying the printing ink
24 Print head
25 Housing
25.1 Housing section
26 Interior
27 Single jet
28 Opening
29 Electrode
30 Printing point

What is claimed is:

1. A method of operating a labeling arrangement configured to label filled, closed beverage bottles and print on beverage bottle caps of filled, closed beverage bottles, said labeling arrangement comprising: a labeling machine being configured and disposed to label filled, closed beverage bottles with a label; at least one printing arrangement being configured to print on caps of beverage bottles; a rotor being configured and disposed to move beverage bottles to and from said labeling machine and to said printing arrangement; said printing arrangement comprising: a transport apparatus being configured and disposed to move beverage bottles through said at least one printing arrangement; said transport apparatus being configured to prevent beverage bottles from rotating about a bottle axis to permit said printing arrangement to print at least one clearly, discernible printing; a monitoring system being configured and disposed to receive information and send information to said printing arrangement; said monitoring system comprising: at least one sensor being configured and disposed to detect markings on each label of each beverage bottle; and a memory being configured and disposed to store electronic images to be compared with information sent from said at least one sensor; said monitoring system further being configured to compare information sent from said at least one sensor to electronic images in said memory in order to determine orientation of each label of each beverage bottle; said printing arrangement comprising: at least one printing station comprising at least one printing unit being configured and disposed to print on caps of beverage bottles; and a printing station control system being configured and disposed to control said at least one printing unit; said printing station control system being further configured to receive information sent from said monitoring system; said printing station being configured to print on a beverage bottle cap of each beverage bottle depending on the orientation of each label on each beverage bottle, such that the orientation of a printing on a beverage bottle cap is aligned with the orientation of a label of the same beverage bottle in a predetermined spatial relationship;

said method comprising:

transporting filled, closed beverage bottles to said labeling machine;

labeling filled, closed beverage bottles with a label;

transporting filled, closed beverage bottles from said labeling machine to said transport apparatus of said printing arrangement;

preventing filled, closed beverage bottles from rotating about a bottle axis;

detecting markings on each label of each closed, filled beverage bottle with said at least one sensor;

sending information regarding the markings on each label of each closed, filled beverage bottle to said monitoring system;

comparing the information regarding the markings on each label of each closed, filled beverage bottle with electronic images stored in said memory;

sending information from said monitoring system to said printing station control system;

printing on a beverage bottle cap of each filled, closed beverage bottle depending on the orientation of each label on each filled, closed beverage bottle, such that the orientation of the printing on a beverage bottle cap is aligned with the orientation of a label of the same filled, closed beverage bottle in a predetermined spatial relationship.

2. The method of operating the labeling arrangement according to claim 1, wherein:

said transport apparatus comprises at least one clamping device configured to substantially minimize movement of filled, closed beverage bottles in said transport apparatus;

said at least one sensor comprises an optoelectric sensor;

said optoelectric sensor comprises one of (A) and (B):

(A) an electronic camera; and (B) a scanner;

said at least one sensor is also configured to detect shapes of filled, closed beverage bottles.

3. The method of operating a labeling arrangement according to claim 2, wherein:

said at least one printing unit is configured to print on portions of beverage bottle caps which are substantially perpendicular to a longitudinal beverage bottle axis;

said printing station control system comprises electronically stored printing masks, which electronically stored printing masks comprise a complete design in terms of graphics, text, and/or image;

said at least one printing unit comprises at least one electrostatic printhead having a horizontal printhead longitudinal axis, which said at least one electrostatic printhead comprises a plurality of individually controllable single jets;

said plurality of individually controllable single jets are configured to control the discharge of printing ink; and said plurality of individually controllable single jets are disposed in at least one row, which at least one row is at least substantially perpendicular to said horizontal printhead longitudinal axis.

4. The method of operating a labeling arrangement according to claim 3, wherein said method further comprises:

at least partially changing said printing mask during printing;

moving a filled, closed beverage bottle and said at least one electrostatic printhead with respect to one another while substantially simultaneously printing on portions of beverage bottle caps which are substantially perpendicular to a longitudinal beverage bottle axis;

said moving at least one of a filled, closed beverage bottle and said at least one electrostatic printhead with respect to one another comprises moving at a right angle to the vertical height of said at least one electrostatic printhead;

said at least one row of electrostatic printheads is disposed at a right angle with respect to portions of beverage bottle caps which are substantially perpendicular to a longitudinal beverage bottle axis and across the width of portions of beverage bottle caps; and said at least one electrostatic printhead is disposed above a portion of the beverage bottle cap which portion of the beverage bottle cap is substantially perpendicular to a longitudinal beverage bottle axis.

5. The method of operating a labeling arrangement according to claim 4, wherein:

each said at least one printing unit is configured to print in at least one color;

each said at least one electrostatic print head is configured to store and print one color;

said printing arrangement further comprises a drying unit configured to dry or set printings printed on beverage bottle caps by applying at least one of: energy, heat, and ultraviolet light to a beverage bottle;

the step of printing on a beverage bottle cap of each filled, closed beverage bottle is performed in said labeling machine; and said at least one printing unit comprises one of (C) and (D):

(C) at least two printheads; and (D) at least three printheads.

6. A labeling arrangement configured to label filled, closed beverage bottles and print on beverage bottle caps of filled, closed beverage bottles, said labeling arrangement comprising:

a labeling machine being configured and disposed to label filled, closed beverage bottles with a label;

at least one printing arrangement being configured to print on caps of beverage bottles;

a rotor being configured and disposed to move beverage bottles to and from said labeling machine and to said printing arrangement;

said printing arrangement comprising:

a transport apparatus being configured and disposed to move beverage bottles through said at least one printing arrangement;

said transport apparatus being configured to prevent beverage bottles from rotating about a bottle axis to permit said printing arrangement to print at least one clearly, discernible printing;

a monitoring system being configured and disposed to receive information and send information to said printing arrangement;

said monitoring system comprising:

at least one sensor being configured and disposed to detect markings on each label of each beverage bottle; and a memory being configured and disposed to store electronic images to be compared with information sent from said at least one sensor;

said monitoring system further being configured to compare information sent from said at least one sensor to electronic images in said memory in order to determine orientation of each label of each beverage bottle;

said printing arrangement comprising:

at least one printing station comprising at least one printing unit being configured and disposed to print on caps of beverage bottles; and a printing station control system being configured and disposed to control said at least one printing unit;

said printing station control system being further configured to receive information sent from said monitoring system;

said printing station being configured to print on a beverage bottle cap of each beverage bottle depending on the orientation of each label on each beverage bottle, such that the orientation of a printing on a beverage bottle cap is aligned with the orientation of a label of the same beverage bottle in a predetermined spatial relationship.

7. The labeling arrangement according to claim 6, wherein:

said transport apparatus comprises at least one clamping device configured to substantially minimize movement of filled, closed beverage bottles in said transport apparatus;

said at least one sensor comprises an optoelectric sensor;

said optoelectric sensor comprises one of (A) and (B):

(A) an electronic camera; and (B) a scanner;

said at least one sensor is also configured to detect shapes of filled, closed beverage bottles;

said at least one printing unit is configured to print on portions of beverage bottle caps which are substantially perpendicular to a longitudinal beverage bottle axis;

said printing station control system comprises electronically stored printing masks, which electronically stored printing masks comprise a complete design in terms of graphics, text, and/or image;

said at least one printing unit comprises at least one electrostatic printhead having a horizontal printhead longitudinal axis, which said at least one electrostatic printhead comprises a plurality of individually controllable single jets;

said plurality of individually controllable single jets are configured to control the discharge of printing ink;

said plurality of individually controllable single jets are disposed in at least one row, which at least one row is at least substantially perpendicular to said horizontal printhead longitudinal axis;

said printing station control system is configured to at least partially change said printing mask during printing;

said printing arrangement is configured to move a filled, closed beverage bottle and said at least one electrostatic printhead with respect to one another while substantially simultaneously printing on portions of beverage bottle caps which are substantially perpendicular to a longitudinal beverage bottle axis;

said printing arrangement is further configured to move a filled, closed beverage bottle and said at least one electrostatic printhead with respect to one another at a right angle to the vertical height and across the width of said at least one electrostatic printhead;

said at least one row of electrostatic printheads is disposed at a right angle with respect to portions of beverage bottle caps which are substantially perpendicular to a longitudinal beverage bottle axis;

said at least one electrostatic printhead is disposed above a portion of the beverage bottle cap which portion of the beverage bottle cap is substantially perpendicular to a longitudinal beverage bottle axis;

each of said at least one printing unit is configured to print in at least one color;

each of said at least one electrostatic print head is configured to store and print one color;

said printing arrangement further comprises a drying unit configured to dry or set printings printed on beverage bottle caps by applying at least one of: energy, heat, and ultraviolet light to a beverage bottle;

said labeling machine is configured to print on a beverage bottle cap of each filled, closed beverage bottle; and said at least one printing unit comprises one of (C) and (D):

(C) at least two printheads; and (D) at least three printheads.

8. A method of operating an indicium-adding arrangement configured to add indicia on at least one predetermined portion being substantially transverse to a longitudinal container axis of a container, said indicium-adding arrangement comprising: a transport apparatus being configured and disposed to move containers through said indicium-adding arrangement; said transport apparatus being configured to substantially minimize movement of containers upon containers being fed through said at least one indicium-adding arrangement to permit said indicia-adding arrangement to add at least one clearly, discernible indicium; a monitoring system being configured and disposed to receive information and send information to said indicium-adding arrangement; said monitoring system comprising: at least one sensor being configured and disposed to detect at least one indicium on at least one portion of a container; and a memory being configured and disposed to store information regarding portions of a container to be compared with information sent from said at least one sensor; said monitoring system further being configured to compare information sent from said at least one sensor to information regarding portions of a container in said memory in order to determine orientation of at least one indicium on at least one portion of a container; said at least one indicium-adding arrangement comprising: at least one indicium-adding station comprising at least one indicium-adding unit being configured and disposed to add indicia on at least one predetermined portion substantially transverse to a longitudinal container axis of containers; and an indicium-adding station control system being configured and disposed to control said at least one indicium-adding unit; said indicium-adding station control system being further configured to receive information sent from said monitoring system; said indicium-adding station being configured to produce indicia on at least one predetermined portion substantially transverse to a longitudinal container axis of a container depending on the orientation of at least one indicium on at least one portion of a container, such that the orientation of at least one indicium on at least one predetermined portion substantially transverse to a longitudinal container axis of the container is aligned with the orientation of at least one indicium on at least one portion of the same container in a predetermined spatial relationship; said method comprising:

transporting containers past said at least one sensor and through said indicium-adding arrangement;

detecting at least one indicium on at least one portion of a container with said at least one sensor;

sending information regarding at least one indicium on at least one portion of a container to said monitoring system;

comparing the information regarding at least one indicium on at least one portion of a container with information stored in said memory;

sending information from said monitoring system to said indicium-adding arrangement;

adding indicia on at least one predetermined portion substantially transverse to a longitudinal container axis of a container depending on the orientation of at least one indicium on at least one portion of a container, such that the orientation of at least one indicium on at least one predetermined portion substantially transverse to a longitudinal container axis of a container is aligned with the orientation of at least one indicium on at least one portion of the same container in a predetermined spatial relationship.

9. The method of operating said indicium-adding arrangement according to claim 8, wherein said transport apparatus comprises at least one clamping device configured to substantially minimize movement of containers in said transport apparatus.

10. The method of operating said indicium-adding arrangement according to claim 9, wherein said at least one sensor comprises an optoelectric sensor;

said optoelectric sensor comprises one of (A) and (B):

(A) an electronic camera; and (B) a scanner;

said at least one sensor is also configured to detect shapes of containers.

11. The method of operating said indicium-adding arrangement according to claim 10, wherein:

said at least one printing unit is configured to print on predetermined portions substantially transverse to a longitudinal container axis of a container which are substantially perpendicular to a longitudinal container axis;

said printing station control system comprises electronically stored printing masks, which electronically stored printing masks comprise a complete design in terms of graphics, text, and/or image;

said at least one printing unit comprises at least one electrostatic printhead having a horizontal printhead longitudinal axis, which said at least one electrostatic printhead comprises a plurality of individually controllable single jets;

said plurality of individually controllable single jets are configured to control the discharge of printing ink;

said plurality of individually controllable single jets are disposed in at least one row, which at least one row is at least substantially perpendicular to said horizontal printhead longitudinal axis.

12. The method of operating said indicium-adding arrangement according to claim 11, wherein said method further comprises:

at least partially changing said printing mask during printing;

moving a container and said at least one electrostatic printhead with respect to one another while substantially simultaneously printing on predetermined portions substantially perpendicular to a longitudinal container axis;

said moving at least one of a container and said at least one electrostatic printhead with respect to one another comprises moving at a right angle to the vertical height of said at least one electrostatic printhead.

13. The method of operating said indicium-adding arrangement according to claim 12, wherein:

said at least one row of electrostatic printheads is disposed at a right angle with respect to predetermined portions which are substantially perpendicular to a longitudinal container axis and across the width of predetermined portions substantially perpendicular to a longitudinal container axis of containers;

said at least one electrostatic printhead is disposed above a predetermined portion substantially perpendicular to a longitudinal container axis of a container;

each said at least one printing unit is configured to print in at least one color; and each said at least one electrostatic print head is configured to store and print one color.

14. The method of operating said indicium-adding arrangement according to claim 13 including a labeling machine, wherein:

said printing arrangement further comprises a drying unit configured to dry or set printings printed on predetermined portions substantially perpendicular to a longitudinal container axis by applying at least one of: energy, heat, and ultraviolet light to a container;

the step of printing on a predetermined portion substantially perpendicular to a longitudinal container axis of a container is performed in said labeling machine; and said at least one printing unit comprises one of (C) and (D):

(C) at least two printheads; and (D) at least three printheads.

15. An indicium-adding arrangement for performing the method according to claim 8, said indicium-adding arrangement being configured to add indicia on at least one predetermined portion being substantially transverse to a longitudinal container axis of a container, said indicium-adding arrangement comprising:

a transport apparatus being configured and disposed to move containers through said at least one indicium-adding arrangement;

said transport apparatus being configured to substantially minimize movement of containers upon containers being fed through said at least one indicium-adding arrangement to permit said indicia-adding arrangement to add at least one clearly, discernible indicium;

a monitoring system being configured and disposed to receive information and send information to said at least one indicium-adding arrangement;

said monitoring system comprising:

at least one sensor being configured and disposed to detect indicia on at least one portion of each container; and a memory being configured and disposed to store information regarding portions of containers to be compared with information sent from said at least one sensor;

said monitoring system further being configured to compare information sent from said at least one sensor to information regarding portions of containers in said memory in order to determine orientation of each indicium on portions of each container;

said at least one indicium-adding arrangement comprising:

at least one indicium-adding station comprising at least one indicium-adding unit being configured and disposed to add indicia on at least one predetermined portion substantially transverse to a longitudinal container axis of containers; and an indicium-adding station control system being configured and disposed to control said at least one indicium-adding unit;

said indicium-adding station control system being further configured to receive information sent from said monitoring system;

said indicium-adding station being configured to produce indicia on at least one predetermined portion substantially transverse to a longitudinal container axis of each container depending on the orientation of at least one indicium on at least one portion of each container, such that the orientation of at least one indicium on at least one predetermined portion substantially transverse to a longitudinal container axis is aligned with the orientation of at least one indicium on at least one portion of the same container in a predetermined spatial relationship.

16. The indicium-adding arrangement according to claim 15, wherein said transport apparatus comprises at least one clamping device configured to substantially minimize movement of containers in said transport apparatus.

17. The indicium-adding arrangement according to claim 16, wherein said at least one sensor comprises an optoelectric sensor;

said optoelectric sensor comprises one of (A) and (B):

(A) an electronic camera; and (B) a scanner; and said at least one sensor is also configured to detect shapes of containers.

18. The indicium-adding arrangement according to claim 17, wherein:

said at least one printing unit is configured to print on predetermined portions substantially transverse to a longitudinal container axis of a container which are substantially perpendicular to a longitudinal container axis;

said printing station control system comprises electronically stored printing masks, which electronically stored printing masks comprise a complete design in terms of graphics, text, and/or image;

said at least one printing unit comprises at least one electrostatic printhead having a horizontal printhead longitudinal axis, which said at least one electrostatic printhead comprises a plurality of individually controllable single jets;

said plurality of individually controllable single jets are configured to control the discharge of printing ink; and said plurality of individually controllable single jets are disposed in at least one row, which at least one row is at least substantially perpendicular to said horizontal printhead longitudinal axis.

19. The indicium-adding arrangement according to claim 18, wherein:

said at least one printing unit is configured to change said printing mask during printing;

said indicium-adding arrangement is configured to move a container and said at least one electrostatic printhead with respect to one another while substantially simultaneously printing on predetermined portions substantially perpendicular to a longitudinal container axis; and said indicium-adding arrangement is further configured to move at least one of a container and said at least one electrostatic printhead with respect to one another comprises moving at a right angle to the vertical height and across the width of said at least one electrostatic printhead.

20. The indicium-adding arrangement according to claim 19 including a labeling machine, wherein:

said at least one row of electrostatic printheads is configured to be disposed at a right angle with respect to predetermined portions which are substantially perpendicular to a longitudinal container axis during operation;

said at least one electrostatic printhead is configured to be disposed above a predetermined portion substantially perpendicular to a longitudinal container axis of a container during operation;

each said at least one printing unit is configured to print in at least one color;

each said at least one electrostatic print head is configured to store and print one color;

said printing arrangement further comprises a drying unit configured to dry or set indicia produced on predetermined portions substantially perpendicular to a longitudinal container axis by applying at least one of: energy, heat, and ultraviolet light to a container;

said labeling machine is configured to print on a predetermined portion substantially perpendicular to a longitudinal container axis of a container; and said at least one printing unit comprises one of (C) and (D):

(C) at least two printheads; and (D) at least three printheads.

* * * * *